US010415893B2

(12) United States Patent
Gorgy

(10) Patent No.: US 10,415,893 B2
(45) Date of Patent: Sep. 17, 2019

(54) HEAT TRANSFER SURFACE

(71) Applicant: Wieland Copper Products, LLC, Pine Hall, NC (US)

(72) Inventor: Evraam Gorgy, La Crosse, WI (US)

(73) Assignee: WIELAND-WERKE AG, Ulm (DE)

( * ) Notice: Subject to any disclaimer, the term of this patent is extended or adjusted under 35 U.S.C. 154(b) by 0 days.

(21) Appl. No.: 15/884,828

(22) Filed: Jan. 31, 2018

(65) Prior Publication Data

US 2018/0187983 A1 Jul. 5, 2018

Related U.S. Application Data

(62) Division of application No. 15/398,417, filed on Jan. 4, 2017, now Pat. No. 9,945,618.

(51) Int. Cl.

| | |
|---|---|
| ***F28F 1/20*** | (2006.01) |
| ***F28F 1/12*** | (2006.01) |
| ***F28D 21/00*** | (2006.01) |
| ***F28F 3/04*** | (2006.01) |
| ***F28F 13/18*** | (2006.01) |
| ***F28F 1/36*** | (2006.01) |
| ***B21C 37/20*** | (2006.01) |

(52) U.S. Cl.

CPC ..... *F28F 1/12* (2013.01); *B21C 37/205* (2013.01); *B21C 37/207* (2013.01); *F28D 21/00* (2013.01); *F28F 1/36* (2013.01); *F28F 3/048* (2013.01); *F28F 13/187* (2013.01); *F28D 2021/0063* (2013.01); *F28D 2021/0064* (2013.01)

(58) Field of Classification Search

CPC .... F28F 1/12; F28D 21/00; F28D 2021/0064; F28D 2021/0063

USPC ..... 165/181

See application file for complete search history.

(56) References Cited

U.S. PATENT DOCUMENTS 4,168,618 A * 9/1979 Saier ..... B21C 37/207 165/184
4,216,826 A * 8/1980 Fujikake ..... B21C 37/205 165/133
4,313,248 A * 2/1982 Fujikake ..... B21C 37/205 165/133

(Continued)

OTHER PUBLICATIONS

English language Notification Concerning Transmittal of copy of International Preliminary Report on Patentability, International Preliminary Report on Patentability and Written Opinion of the International Searching Authority for corresponding application No. PCT/US2017/068485, Date of Issuance Jul. 9, 2019 (8 pgs).

*Primary Examiner* — Claire E Rojohn, III
(74) *Attorney, Agent, or Firm* — Flynn Thiel, P.C.

(57) ABSTRACT

An exterior surface of a heat transfer tube has a plurality of channels formed into the surface, where the channels are substantially parallel to one another and extend at a first angle to a longitudinal axis to the tube. A plurality of cuts are then made into the surface substantially parallel to one another and extend at a second angle to a longitudinal axis to the tube different from the first angle. Individual fin segments extend from the surface and are separated from one another by the channels and the cuts. The fin segments have a first channel-adjacent edge adjacent substantially parallel to the channel, a first cut-adjacent edge substantially parallel to the cut, and a corner formed by a second channel-adjacent edge and a second cut-adjacent edge. The tube can be used as a condenser tube.

11 Claims, 5 Drawing Sheets

(56) References Cited

U.S. PATENT DOCUMENTS 4,549,606 A * 10/1985 Sato ..... B21C 37/20 165/179
4,660,630 A * 4/1987 Cunningham ..... B21C 37/207 165/133
4,715,436 A * 12/1987 Takahashi ..... B21C 37/20 165/110
4,733,698 A * 3/1988 Sato ..... F28F 1/40 138/38
4,796,693 A * 1/1989 Kastner ..... B21C 37/207 165/133
5,186,252 A * 2/1993 Nishizawa ..... F28F 1/26 165/133
5,203,404 A * 4/1993 Chiang ..... F28F 13/185 165/133
5,259,448 A * 11/1993 Masukawa ..... B21C 37/202 165/133
5,333,682 A * 8/1994 Liu ..... F28F 1/26 165/133
5,353,865 A * 10/1994 Adiutori ..... F28F 13/02 165/109.1
5,458,191 A * 10/1995 Chiang ..... F28F 1/40 165/133
5,597,039 A * 1/1997 Rieger ..... F28F 1/42 165/133
5,669,441 A * 9/1997 Spencer ..... B21C 37/20 165/133
5,697,430 A * 12/1997 Thors ..... F28F 1/36 165/133
5,704,424 A * 1/1998 Kohno ..... B21C 37/20 165/184
5,775,411 A * 7/1998 Schuez ..... B21C 37/207 165/133
5,975,196 A * 11/1999 Gaffaney ..... F28F 1/40 165/133
6,018,963 A * 2/2000 Itoh ..... F25B 39/00 165/133
6,056,048 A * 5/2000 Takahashi ..... F28D 3/02 165/133
6,067,832 A * 5/2000 Brand ..... B21C 37/207 29/890.05
6,167,950 B1 * 1/2001 Gupte ..... F28F 1/36 165/133
6,173,762 B1 * 1/2001 Ishida ..... F28F 1/42 165/133
6,176,301 B1 * 1/2001 Bennett ..... F28F 1/40 165/133
6,176,302 B1 * 1/2001 Takahashi ..... F28F 1/36 165/133
6,182,743 B1 * 2/2001 Bennett ..... F28F 1/40 165/133
6,336,501 B1 * 1/2002 Ishikawa ..... F28F 1/40 165/133
6,427,767 B1 * 8/2002 Mougin ..... F28F 1/36 165/133
6,655,451 B2 * 12/2003 Tada ..... B01D 1/065 138/38
6,913,073 B2 * 7/2005 Beutler ..... B21C 37/207 165/133
7,178,361 B2 * 2/2007 Thors ..... F25B 39/02 62/515
7,254,964 B2 * 8/2007 Thors ..... F25B 39/02 165/184
7,311,137 B2 * 12/2007 Thors ..... B21C 37/20 165/133
7,509,828 B2 * 3/2009 Thors ..... B21C 37/158 408/147
7,637,012 B2 * 12/2009 Thors ..... B21C 37/20 29/890.049
7,789,127 B2 9/2010 Lu et al.
8,490,679 B2 * 7/2013 Campbell ..... F28D 15/02 165/80.2
8,505,497 B2 * 8/2013 Lundgreen ..... F28F 13/187 122/15.1
8,550,152 B2 * 10/2013 Beutler ..... F28F 1/26 165/133
8,613,308 B2 * 12/2013 Daly ..... B21C 37/207 165/163
8,857,505 B2 * 10/2014 Beutler ..... B21C 37/207 165/179
8,997,846 B2 * 4/2015 Kucherov ..... F28F 3/04 165/109.1
9,188,287 B2 * 11/2015 Krautschick ..... F15D 1/065
9,328,975 B2 * 5/2016 Furumaki ..... F28D 1/05383
9,488,378 B2 * 11/2016 Peterle ..... F28D 1/0226
9,502,259 B2 * 11/2016 Li ..... H01L 21/3081
9,618,279 B2 * 4/2017 Lutz ..... F28F 13/187
9,683,791 B2 * 6/2017 Wu ..... F28F 1/422
2002/0000312 A1 * 1/2002 Brand ..... F28F 13/187 165/179
2007/0034361 A1 * 2/2007 Lu ..... F28F 1/26 165/133
2007/0131396 A1 * 6/2007 Yu ..... F25B 39/04 165/133
2007/0151715 A1 * 7/2007 Yunyu ..... F28F 1/38 165/133
2008/0196876 A1 * 8/2008 Cao ..... F28F 1/36 165/181
2009/0071624 A1 * 3/2009 Zhang ..... F28F 1/16 165/80.3
2009/0260792 A1 * 10/2009 Yalin ..... B21C 37/207 165/181
2010/0186443 A1 * 7/2010 Zhang ..... F01K 23/10 62/515
2012/0111551 A1 * 5/2012 Cao ..... F28F 1/36 165/181

* cited by examiner

HEAT TRANSFER SURFACE

This is a divisional of prior U.S. application Ser. No. 15/398,417, filed Jan. 4, 2017.

BACKGROUND AND SUMMARY OF THE INVENTION

Enhanced heat transfer surfaces are used in many cooling applications, for example, in the HVAC industry, for refrigeration and appliances, in cooling of electronics, in the power generation industry, and in the petrochemical, refining and chemical processing industries. Enhanced heat transfer tubes for condensation and evaporation type heat exchangers have a high heat transfer coefficient. The tube surface of the present disclosure comprises a surface ideal for use as a condenser tube, while additional steps in the method of forming the tube will result in a surface ideal for use as an evaporator tube.

A method for forming features in an exterior surface of a heat transfer tube according to the present disclosure comprises forming a plurality of channels into the surface, where the channels are substantially parallel to one another and extend at a first angle to a longitudinal axis to the tube. A plurality of cuts are made into the surface, the cuts substantially parallel to one another and extending at a second angle to a longitudinal axis to the tube, the second angle different from the first angle. The cutting step forms individual fin segment extending from the surface, the fin segments separated from one another by the channels and the cuts. The fin segments comprise a first channel-adjacent edge adjacent substantially parallel to the channel, a first cut-adjacent edge substantially parallel to the cut, and a corner formed by a second channel-adjacent edge and a second cut-adjacent edge, the corner rising upward from a channel floor and partially extending into the channel. A tube formed using this method has excellent qualities for use as a condenser tube.

Additional steps in the method will result in an excellent evaporator tube. Following the cutting step discussed above, the fin segments are compressed with a roller, causing an edge of the fin segments to bend at least partially over the cuts. The step of compressing the fin segments further causes an edge of the fin segments to extend at least partially over the channels.

For purposes of summarizing the invention, certain aspects, advantages, and novel features of the invention have been described herein. It is to be understand that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

The disclosure can be better understood with reference to the following drawings. The elements of the drawings are not necessarily to scale, emphasis instead being placed upon clearly illustrating the principles of the disclosure. Furthermore, like reference numerals designate corresponding parts throughout the several views.

DETAILED DESCRIPTION

Figure 1:
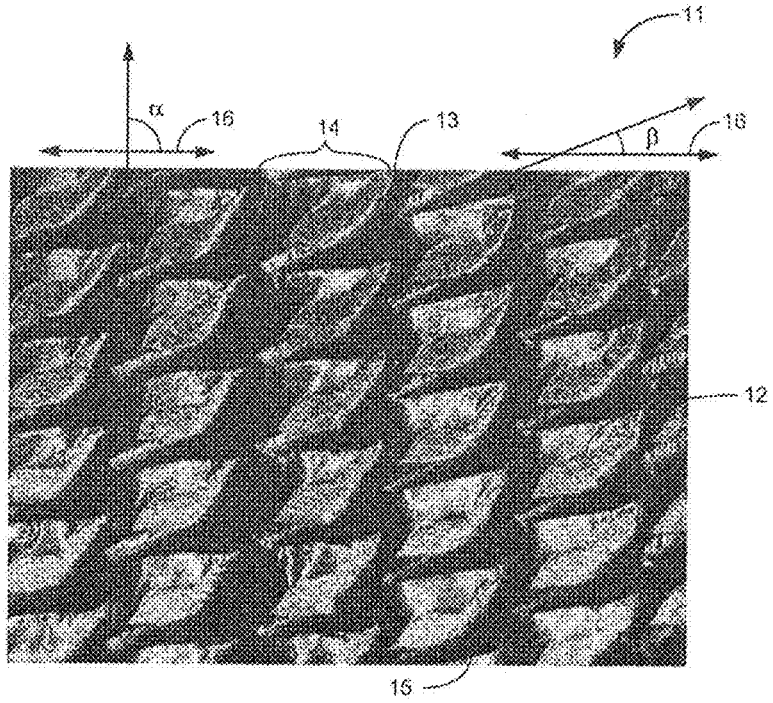
FIG. 1 is an enlarged photograph of the external surface of an evaporator heat transfer tube according to an exemplary embodiment of the present disclosures.

FIG. 1 is an enlarged photograph of the external surface 11 of a heat transfer tube (not shown) used as an evaporator tube, which surface 11 has been finned, cut and compressed to form a plurality of fin segments 12 that are somewhat trapezoidal in shape. The finning, cutting and compressing is achieved using techniques similar to those disclosed in U.S. Pat. No. 4,216,826 to Fujikake.

Channels 13 extend substantially parallel to one another between adjacent columns 14 of fin segments 12. The channels are formed at an angle "$\alpha$" to a longitudinal direction 16 of the tube. In one embodiment, the angle $\alpha$ is between 85 and 89.5 degrees.

Cuts 15 extend at an angle "$\beta$" to the longitudinal direction 16 of the tube and bound the fin segments 12. In this regard, the fin segments 12 are bounded on opposed sides by the channels 14 and the cuts 15, as further discussed herein. The angle $\beta$ may be between 10 degrees and 35 degrees, and in one embodiment is approximately 15 degrees.

Figure 2:
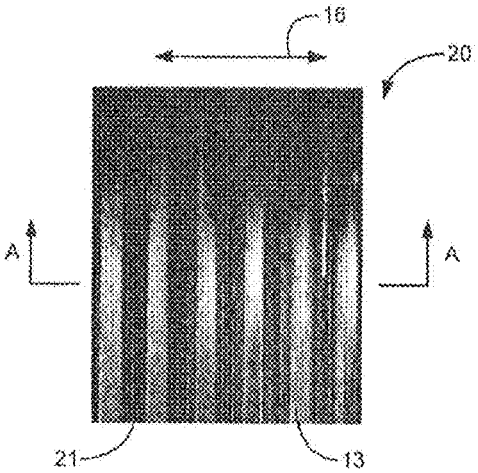
FIG. 2 is an enlarged photograph of the external surface of a tube that has had channels formed in the surface.

FIG. 2 is an enlarged photograph of the external surface 20 of a tube after the channels 13 have been formed, and before the cuts 15 (FIG. 1) have been made. The channels are formed using methods known in the art, and in particular disclosed in Fujikake. In this regard, a rolling tool (not shown) with fin-forming disk tools (not shown) is pressed onto the surface of the tube while fin disks are rotating, to form the fins 21. As discussed above with respect to FIG. 1, the channels 13 are disposed at an angle $\alpha$ (FIG. 1) to the longitudinal direction 16 of the tube. The fins 21 are separated from one another by the channels 13.

Figure 3:
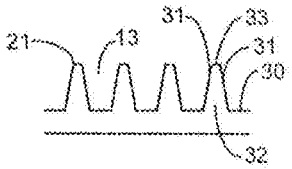
FIG. 3 is a cross-sectional view of the surface of FIG. 2, taken along section A-A of FIG. 2.

FIG. 3 is a cross-sectional view of the surface 20 of FIG. 2. The fins 21 extend upwardly from a channel bottom 30 as shown. Each fin 21 comprises angled side edges 31 such that a base 32 of the fin 21 is wider than a top 33 of the fin 21. After the fins 21 are formed, a cutting disk (not shown) is applied to the surface 20 to form the cuts 15 (FIG. 1).

Figure 4:
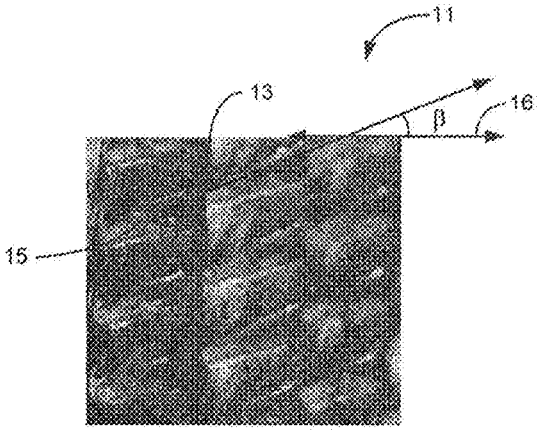
FIG. 4 is an enlarged photograph of the external surface of a tube that has undergone a cutting operation to form cuts at an angle to the channels.

FIG. 4 is an enlarged angled photo of the surface 11 of FIG. 1, after the cutting operation is complete and before the surface 11 is rolled. As discussed above with respect to FIG. 1, the cuts 15 are disposed at an angle $\beta$ to the longitudinal direction 16 of the tube. The angle $\beta$ is generally 15 degrees in the illustrated embodiment. The cutting operation forms individual fin segments 12.

Figure 5:
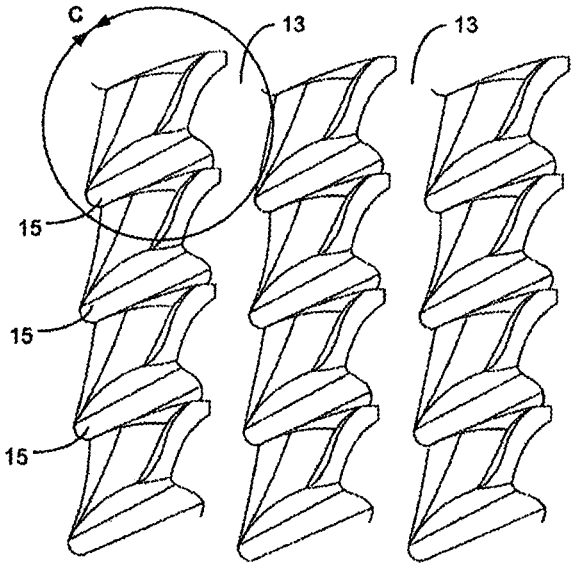
FIG. 5 depicts a top plan view of a cut (but not rolled) surface according to FIG. 4.

FIG. 5 is a top view representation of a surface of FIG. 4, after cutting and before rolling. The individual fin segments 12 are separated by the channels 13 and the cuts 15.

Figure 6:
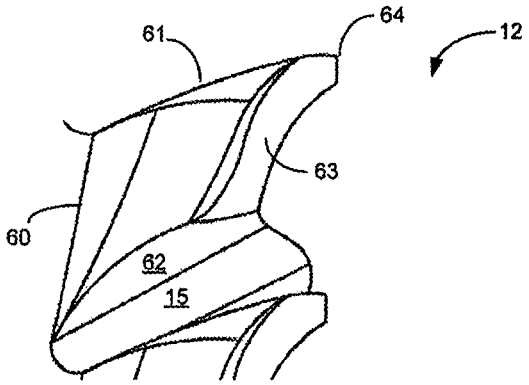
FIG. 6 is an enlarged view of a fin segment of FIG. 5, taken along detail line "C" of FIG. 5.

FIG. 6 is an enlarged detail view of a fin segment 12 of FIG. 5, taken along detail line "C" of FIG. 5. The fin segments 12 are comprised of cut-adjacent sides 61 and 62 and channel-adjacent sides 60 and 63. Side 60 is generally parallel with the channel 13, though none of the sides 61-63 comprise straight lines. Side 62 is generally parallel with the cut 15. Sides 61 and 63 meet each other at a corner 64. The corner 64 is somewhat sharp, and is raised up over and extends into the channel 13.

At this point in the process, after cutting of the fin segments 12, the tube surface (as pictured in FIGS. 4 and 5) is ideal for use on condenser tubes. If an evaporator tube surface is desired instead, a final rolling operation is performed to produce the surface shown in FIG. 1. In this regard, after the cuts 15 are formed, a rolling operation is performed whereby a roller (not shown) is applied to the surface to form the final shape of the fin segments 12 (FIG. 7).

Figure 7:
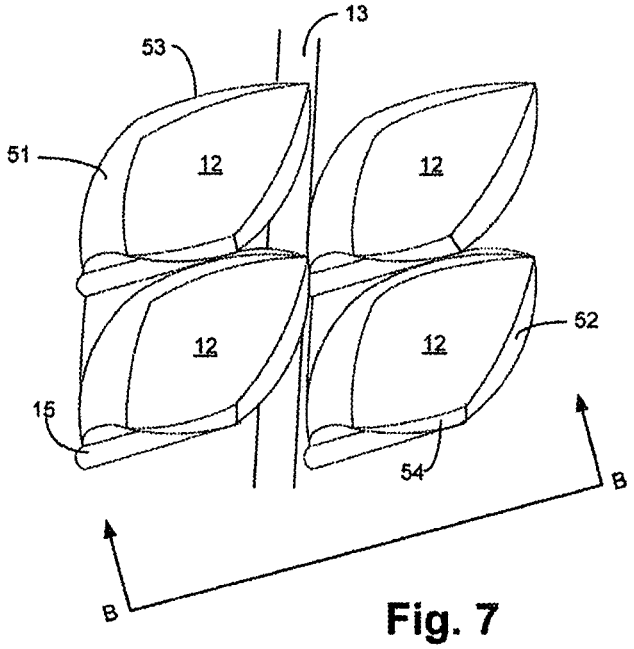
FIG. 7 depicts an enlarged top view of the surface of FIG. 1.

FIG. 7 depicts an enlarged top view of the evaporator tube surface 11 of FIG. 1, showing a plurality of fin segments 12 bounded by the channels 13 on opposed sides and by the cuts 15 on opposed sides. In this regard, each fin segment 12 comprises four edges: a channel-side edge 51 opposite a channel-overlapping edge 52, and a cut-side edge 53 opposite a cut-overlapping edge 54. The channel-side edge 51 is generally parallel to the channel 13, though has a somewhat curved edge as shown, caused by the rolling operation. The cut-side edge 53 is generally parallel to the cut 15, though has a somewhat curved edge as shown, caused by the rolling operation.

The channel-overlapping edge 52 has been caused by the rolling operation to at least partially overlap the channel 13 as shown. The rolling operation thus deforms the channel-overlapping edge 52 to cause it to overlap the channel 13. Similarly, the cut-overlapping edge 54 has been caused by the rolling operation to at least partially overlap the cut 15 as shown. The cut-overlapping edge 54 is adjacent to the channel-overlapping edge 52. The cut-side edge 53 is adjacent to the channel-side edge 51.

Figure 8:
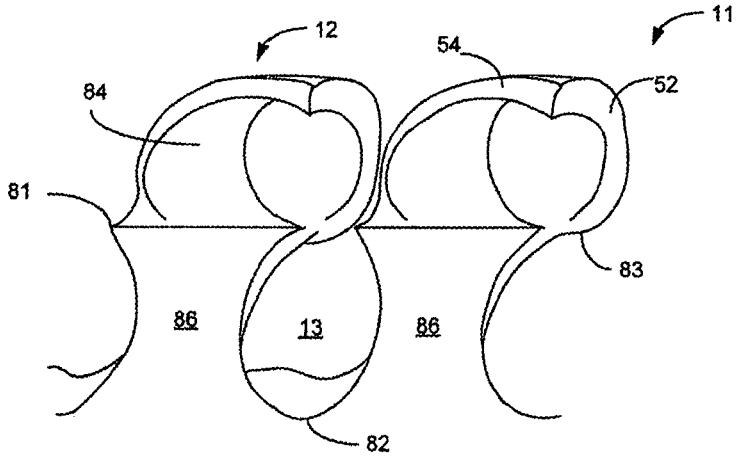
FIG. 8 is a cross-sectional view of the surface of FIG. 7, taken along sectional lines B-B of FIG. 5.

FIG. 8 is a cross-sectional view of the surface 11 of FIG. 7, taken along section lines B-B of FIG. 7. A stem 86 of the fin segments 12 extends upwardly from a channel bottom 82. A cut bottom 81 is disposed above the channel bottom 82, because the cuts are not as deep as the channels. The channel-overlapping edge 52 overlapping the channel 13 and the cut-overlapping edge 54 overlapping the cut 15 (FIG. 5) form a cavity 84 beneath the edges 52 and 54 the stem 86, and the cut 15.

The channel-overlapping edge 52 bends downwardly toward the channel, and in some places (indicated by reference number 83) may extend below the cut bottom 81.

Figure 9:
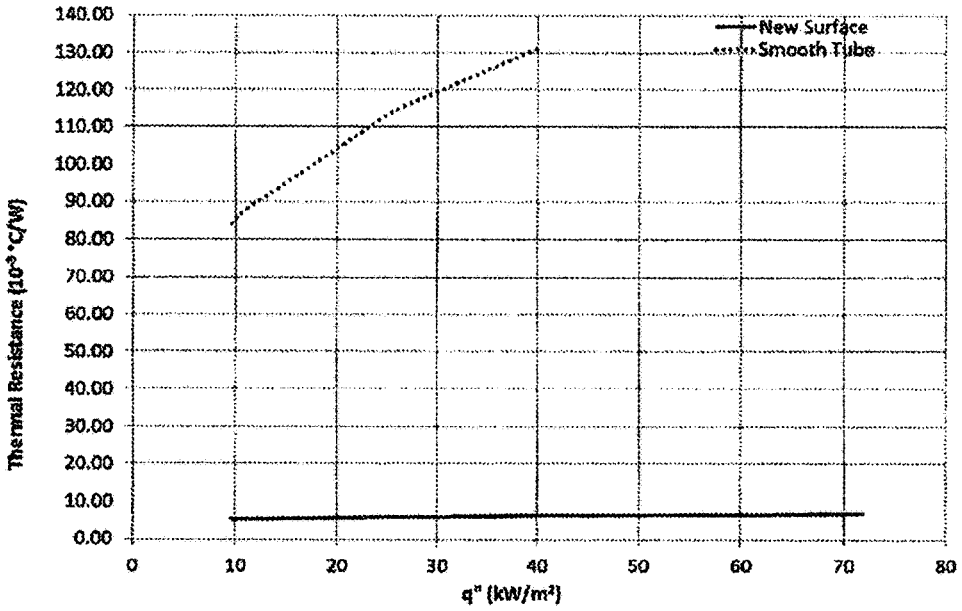
FIG. 9 depicts performance data of a condenser tube according to the present disclosure when compared with a prior art tube.

FIG. 9 depicts performance data of a ¾" condenser tube 92 according to the present disclosure (annotated "New Surface" on FIG. 9) when compared with smooth tube 91. The heat transfer performance of the tube's surface can be evaluated by testing the surface's thermal resistance. The thermal resistance is plotted against a heat flux range to evaluate the surface efficiency at different levels of heat load per unit area. Lower thermal resistance indicates more efficient heat transfer process.

Figure 10:
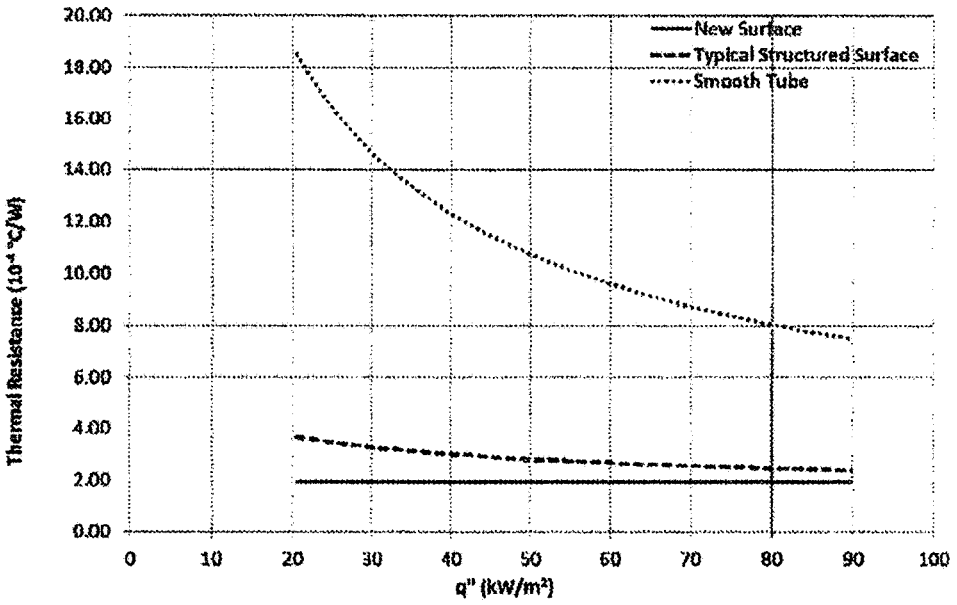
FIG. 10 depicts performance data of an evaporator tube according to the present disclosure when compared with prior art tubes.

FIG. 10 depicts performance data of a ¾" evaporator tube 70 according to the present disclosure (annotated "New Surface" on FIG. 10) when compared with a typical prior art structured surface tube 71 and a smooth tube 72. The heat transfer performance of the tube's surface can be evaluated by testing the surface's thermal resistance. The thermal resistance is plotted against a heat flux range to evaluate the surface efficiency at different levels of heat load per unit area. Lower thermal resistance indicates more efficient heat transfer process.

The evaporator or condenser tube surfaces according to the present disclosure are generally used in boiling heat transfer applications whereas a single tube or a bundle of tubes is used in heat exchangers. Refrigerant evaporators are one example where the disclosed surface is used.

The embodiments discussed herein are for enhanced tube surfaces. However, as one with skill in the art, the same principles and methods can be applied to enhance a flat surface as well.

What is claimed is:

1. A heat transfer tube with an outer surface comprising a plurality of outwardly extending fins with channels extending between adjacent fins, the channels extending at a first angle to a longitudinal axis of the tube, a plurality of cuts formed on the fins, the cuts extending at a second angle to a longitudinal axis of the tube, the second angle being different from the first angle, the cuts producing fin segments, each fin segment comprising a stem, a top surface, and a deformed edge extending from and bending downwardly from the top surface, the deformed edge at least partially overlapping the cut adjacent to the fin segment.

2. The heat transfer tube of claim 1, wherein the deformed edge at least partially overlaps the channel adjacent to the deformed edge.

3. The heat transfer tube of claim 2, wherein the deformed edge comprises a cut-overlapping edge and a channel-overlapping edge.

4. The heat transfer tube of claim 1, wherein adjacent fin segments form a cavity therebetween.

5. The heat transfer tube of claim 4, the cavity comprising a boiling pore formed between the deformed edge, the stem, and the cut.

6. The heat transfer tube of claim 1, wherein the first angle is between 85 and 89.5 degrees.

7. The heat transfer tube of claim 1, wherein the second angle is between 10 to 35 degrees.

8. The heat transfer tube of claim 1, wherein the second angle is substantially 15 degrees.

9. The heat transfer tube of claim 1, wherein the top surface is trapezoidal in shape.

10. The heat transfer tube of claim 1, wherein the deformed edge extends downwardly to the channel.

11. The heat transfer tube of claim 1, wherein the deformed edge extends downwardly more than halfway down the cut.

* * * * *